US009572473B2

(12) United States Patent
Tuller et al.

(10) Patent No.: US 9,572,473 B2
(45) **Date of Patent: *Feb. 21, 2017**

(54) DISHWASHER WITH UNITARY WASH MODULE

(71) Applicant: Whirlpool Corporation, Benton Harbor, MI (US)

(72) Inventors: Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/669,498

(22) Filed: Mar. 26, 2015

(65) Prior Publication Data

US 2015/0196187 A1 Jul. 16, 2015

Related U.S. Application Data

(63) Continuation of application No. 12/959,507, filed on Dec. 3, 2010, now Pat. No. 9,119,515.

(51) Int. Cl.

| | |
|---|---|
| ***A47L 15/42*** | (2006.01) |
| ***A47L 15/00*** | (2006.01) |
| ***B08B 3/02*** | (2006.01) |

(52) U.S. Cl.

CPC ..... *A47L 15/0018* (2013.01); *A47L 15/0021* (2013.01); *A47L 15/0084* (2013.01); *A47L 15/4202* (2013.01); *A47L 15/4219* (2013.01); *A47L 15/4225* (2013.01); *A47L 15/4293* (2013.01); *B08B 3/02* (2013.01); *A47L 2301/08* (2013.01); *A47L 2401/02* (2013.01); *A47L 2401/18* (2013.01); *A47L 2401/19* (2013.01); *A47L 2401/26* (2013.01);
(Continued)

(58) Field of Classification Search

CPC ..... A47L 15/0018; A47L 15/0084; A47L 15/4219; A47L 15/4225; A47L 15/4202; A47L 15/0021; A47L 2401/02; A47L 2401/18; A47L 2401/26; A47L 2501/07; A47L 2501/20; A47L 2501/30; A47L 2401/19; B08B 3/02

See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

European Search Report for EP11188106, Mar. 29, 2012.

(Continued)

*Primary Examiner* — Michael Barr
*Assistant Examiner* — Benjamin L Osterhout

(57) ABSTRACT

An automatic dishwasher having a tub defining a treating chamber and a housing physically separate from the tub and defining a sump to receive liquid sprayed into the tub, the housing having an inlet fluidly connected to a liquid outlet of the tub and an outlet fluidly coupled to a sprayer located within the tub to define a recirculation path for the sprayed liquid.

33 Claims, 7 Drawing Sheets

(52) U.S. Cl.
CPC ..... *A47L 2501/07* (2013.01); *A47L 2501/20* (2013.01); *A47L 2501/30* (2013.01)

(56) References Cited

U.S. PATENT DOCUMENTS

| | | | |
|---|---|---|---|
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,186,417 | A | 6/1965 | Fay |
| 3,288,154 | A | 11/1966 | Jacobs |
| 3,378,933 | A | 4/1968 | Jenkins |
| 3,542,594 | A | 11/1970 | Smith et al. |
| 3,575,185 | A | 4/1971 | Barbulesco |
| 3,586,011 | A | 6/1971 | Lamberto |
| 3,739,145 | A | 6/1973 | Woehler |
| 3,801,280 | A | 4/1974 | Shah et al. |
| 3,846,321 | A | 11/1974 | Strange |
| 3,906,967 | A | 9/1975 | Bergeson |
| 3,989,054 | A | 11/1976 | Mercer |
| 4,179,307 | A | 12/1979 | Cau et al. |
| 4,180,095 | A | 12/1979 | Woolley et al. |
| 4,228,962 | A | 10/1980 | Dingler et al. |
| 4,326,552 | A | 4/1982 | Bleckmann |
| 4,754,770 | A | 7/1988 | Fornasari |
| 5,002,890 | A | 3/1991 | Morrison |
| 5,030,357 | A | 7/1991 | Lowe |
| 5,133,863 | A | 7/1992 | Zander |
| 5,331,986 | A | 7/1994 | Lim et al. |
| 5,454,298 | A | 10/1995 | Lu |
| 5,470,142 | A | 11/1995 | Sargeant et al. |
| 5,470,472 | A | 11/1995 | Baird et al. |
| 5,557,704 | A | 9/1996 | Dennis et al. |
| 5,569,383 | A | 10/1996 | Vander Ark, Jr. et al. |
| 5,618,424 | A | 4/1997 | Nagaoka |
| 5,630,437 | A | 5/1997 | Dries et al. |
| 5,711,325 | A | 1/1998 | Kloss et al. |
| 5,755,244 | A | 5/1998 | Sargeant et al. |
| 5,782,112 | A | 7/1998 | White et al. |
| 5,803,100 | A | 9/1998 | Thies |
| 5,865,997 | A | 2/1999 | Isaacs |
| 5,868,937 | A | 2/1999 | Back et al. |
| 5,904,163 | A | 5/1999 | Inoue et al. |
| 5,924,432 | A | 7/1999 | Thies et al. |
| 6,289,908 | B1 | 9/2001 | Kelsey |
| 6,389,908 | B1 | 5/2002 | Chevalier et al. |
| 6,443,091 | B1 | 9/2002 | Matte |
| 6,460,555 | B1 | 10/2002 | Tuller et al. |
| 6,491,049 | B1 | 12/2002 | Tuller et al. |
| 6,601,593 | B2 | 8/2003 | Deiss et al. |
| 6,666,976 | B2 | 12/2003 | Benenson, Jr. et al. |
| 6,800,197 | B1 | 10/2004 | Kosola et al. |
| 6,997,195 | B2 | 2/2006 | Durazzani et al. |
| 7,047,986 | B2 | 5/2006 | Ertle et al. |
| 7,069,181 | B2 | 6/2006 | Jerg et al. |
| 7,093,604 | B2 | 8/2006 | Jung et al. |
| 7,153,817 | B2 | 12/2006 | Binder |
| 7,198,054 | B2 | 4/2007 | Welch |
| 7,208,080 | B2 | 4/2007 | Batten et al. |
| 7,232,494 | B2 | 6/2007 | Rappette |
| 7,250,174 | B2 | 7/2007 | Lee et al. |
| 7,270,132 | B2 | 9/2007 | Inui et al. |
| 7,319,841 | B2 | 1/2008 | Bateman, III et al. |
| 7,326,338 | B2 | 2/2008 | Batten et al. |
| 7,347,212 | B2 | 3/2008 | Rosenbauer |
| 7,350,527 | B2 | 4/2008 | Gurubatham et al. |
| 7,363,093 | B2 | 4/2008 | King et al. |
| 7,406,843 | B2 | 8/2008 | Thies et al. |
| 7,445,013 | B2 | 11/2008 | VanderRoest et al. |
| 7,497,222 | B2 | 3/2009 | Edwards et al. |
| 7,523,758 | B2 | 4/2009 | VanderRoest et al. |
| 7,594,513 | B2 | 9/2009 | VanderRoest et al. |
| 7,819,983 | B2 | 10/2010 | Kim et al. |
| 7,896,977 | B2 | 3/2011 | Gillum et al. |
| 8,043,437 | B1 | 10/2011 | Delgado et al. |
| 8,161,986 | B2 | 4/2012 | Alessandrelli |
| 8,215,322 | B2 | 7/2012 | Fountain et al. |
| 8,627,832 | B2 | 1/2014 | Fountain et al. |
| 8,667,974 | B2 | 3/2014 | Fountain et al. |
| 8,746,261 | B2 | 6/2014 | Welch |
| 9,005,369 | B2 | 4/2015 | Delgado et al. |
| 9,034,112 | B2 | 5/2015 | Tuller et al. |
| 2002/0017483 | A1 | 2/2002 | Chesner et al. |
| 2003/0037809 | A1 | 2/2003 | Favaro |
| 2003/0168087 | A1 | 9/2003 | Inui et al. |
| 2003/0205248 | A1 | 11/2003 | Christman et al. |
| 2004/0007253 | A1 | 1/2004 | Jung et al. |
| 2004/0103926 | A1 | 6/2004 | Ha |
| 2004/0254654 | A1 | 12/2004 | Donnelly et al. |
| 2005/0022849 | A1 | 2/2005 | Park et al. |
| 2005/0133070 | A1 | 6/2005 | Vanderroest et al. |
| 2006/0005863 | A1 | 1/2006 | Gurubatham et al. |
| 2006/0054549 | A1 | 3/2006 | Schoendorfer |
| 2006/0123563 | A1 | 6/2006 | Raney et al. |
| 2006/0162744 | A1 | 7/2006 | Walkden |
| 2006/0174915 | A1 | 8/2006 | Hedstrom et al. |
| 2006/0236556 | A1 | 10/2006 | Ferguson et al. |
| 2006/0237049 | A1 | 10/2006 | Weaver et al. |
| 2006/0237052 | A1 | 10/2006 | Plcardat et al. |
| 2007/0006898 | A1 | 1/2007 | Lee |
| 2007/0107753 | A1 | 5/2007 | Jerg |
| 2007/0119478 | A1 | 5/2007 | King et al. |
| 2007/0124004 | A1 | 5/2007 | King et al. |
| 2007/0163626 | A1 | 7/2007 | Klein |
| 2007/0186964 | A1 | 8/2007 | Mason et al. |
| 2007/0246078 | A1 | 10/2007 | Purtilo et al. |
| 2007/0266587 | A1 | 11/2007 | Bringewatt et al. |
| 2007/0295360 | A1 | 12/2007 | Jerg et al. |
| 2008/0116135 | A1 | 5/2008 | Rieger et al. |
| 2008/0289654 | A1 | 11/2008 | Kim et al. |
| 2008/0289664 | A1 | 11/2008 | Rockwell et al. |
| 2009/0095330 | A1 | 4/2009 | Iwanaga et al. |
| 2009/0283111 | A1 | 11/2009 | Classen et al. |
| 2010/0012159 | A1 | 1/2010 | Verma et al. |
| 2010/0043826 | A1 | 2/2010 | Bertsch et al. |
| 2010/0043828 | A1 | 2/2010 | Choi et al. |
| 2010/0043847 | A1 | 2/2010 | Yoon et al. |
| 2010/0121497 | A1 | 5/2010 | Heisele et al. |
| 2010/0147339 | A1 | 6/2010 | Bertsch et al. |
| 2010/0154830 | A1 | 6/2010 | Lau et al. |
| 2010/0154841 | A1 | 6/2010 | Fountain et al. |
| 2010/0175762 | A1 | 7/2010 | Anacrelico |
| 2010/0224223 | A1 | 9/2010 | Kehl et al. |
| 2010/0252081 | A1 | 10/2010 | Classen et al. |
| 2010/0300499 | A1 | 12/2010 | Han et al. |
| 2011/0061682 | A1 | 3/2011 | Fountain et al. |
| 2011/0120508 | A1 | 5/2011 | Yoon et al. |
| 2011/0126865 | A1 | 6/2011 | Yoon et al. |
| 2012/0097200 | A1 | 4/2012 | Fountain |
| 2012/0138107 | A1 | 6/2012 | Fountain et al. |
| 2012/0167928 | A1 | 7/2012 | Fountain et al. |
| 2012/0318309 | A1 | 12/2012 | Tuller et al. |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |

(56) References Cited

FOREIGN PATENT DOCUMENTS

| | | | |
|---|---|---|---|
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | A | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | A2 | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

European Search Report for EP12188007, Aug. 6, 2013.
German Search Report for DE102010061347, Jan. 23, 2013.
German Search Report for DE102010061215, Feb. 7, 2013.
German Search Report for DE102010061346, Sep. 30, 2011.
German Search Report for DE102010061343, Jul. 7, 2011.
German Search Report for DE102011053666, Oct. 21, 2011.
German Search Report for DE102013103264, Jul. 12, 2013.
German Search Report for DE102013103625, Jul. 19, 2013.
German Search Report for Counterpart DE102013109125, Dec. 9, 2013.
German Search Report for DE102010061342, Aug. 19, 2011.
European Search Report for EP101952380, May 19, 2011.
Ishihara et al., JP 11155792 A, English Machine Translation, 1999, pp. 1-14.
German Search Report for Counterpart DE102014101260.7, Sep. 18, 2014.

DISHWASHER WITH UNITARY WASH MODULE

CROSS REFERENCE TO RELATED APPLICATIONS

This application is a continuation of U.S. patent application Ser. No. 12/959,507, filed Dec. 3, 2010, and entitled Dishwasher with Unitary Wash Module, which is hereby incorporated by reference in its entirety.

BACKGROUND OF THE INVENTION

Contemporary automatic dishwashers for use in a typical household include a tub for receiving soiled utensils to be cleaned. A spray system and a recirculation system may be provided for re-circulating liquid throughout the tub to remove soils from the utensils. An air supply system may be included to provide air to the tub for drying the utensils. The dishwasher may have a controller that implements a number of pre-programmed cycles of operation to wash utensils contained in the tub.

SUMMARY OF THE INVENTION

The invention relates to an automatic dishwasher with a tub defining a treating chamber, a sprayer located in the treating chamber and spraying liquid into the treating chamber and, a housing physically separate from the tub and defining a sump to receive liquid sprayed into the tub, the housing having an inlet fluidly connected to a liquid outlet of the tub and an outlet fluidly coupled to the sprayer located within the tub to define a recirculation path for the sprayed liquid.

DESCRIPTION OF EMBODIMENTS OF THE INVENTION

Figure 1:
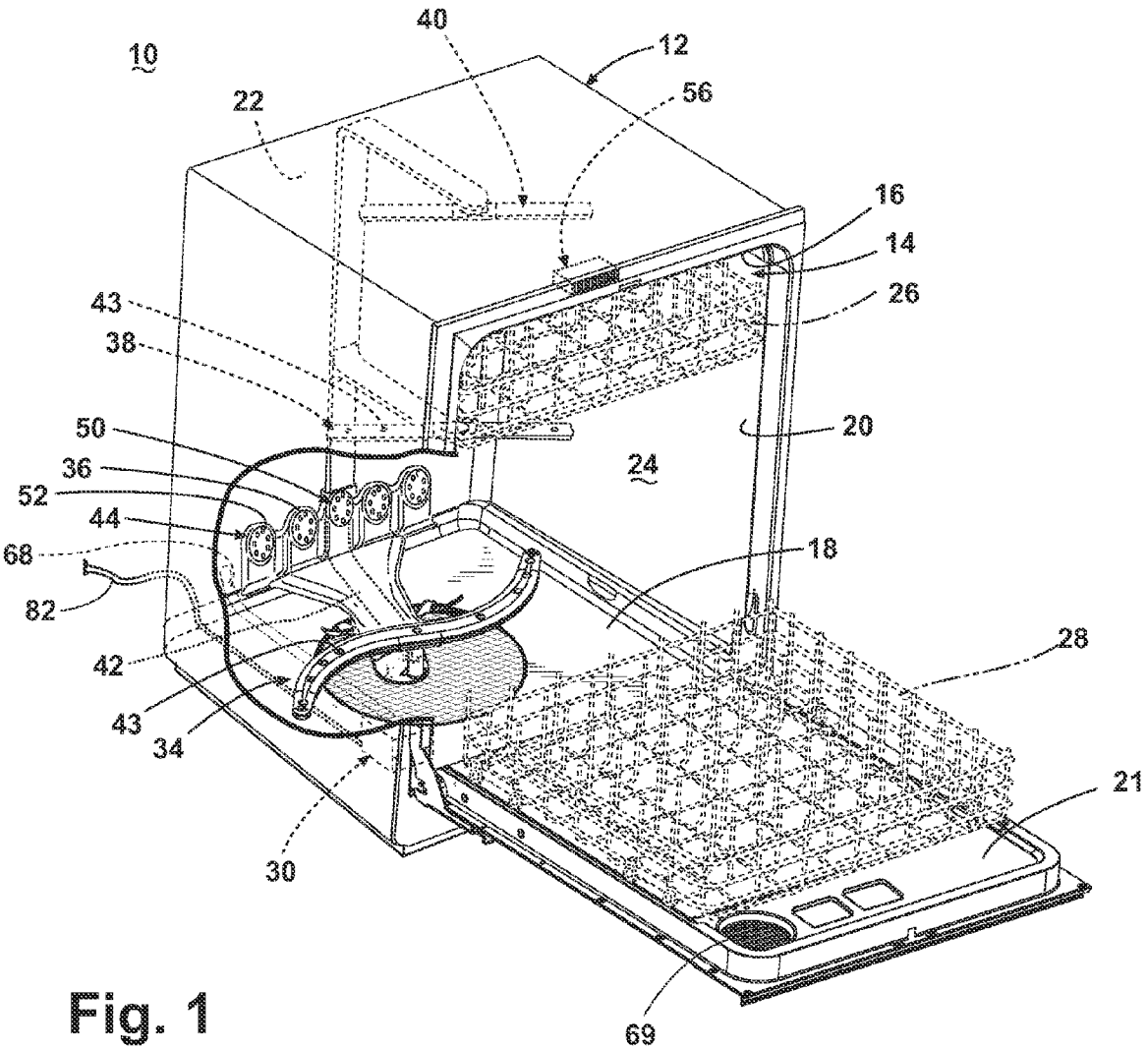
FIG. 1 is a perspective view of a dishwasher in accordance with a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention.

The cabinet 12 encloses a wash tub 14, which at least partially defines a treating chamber 24 for holding utensils for washing according to a cycle of operation. While typically made from a single piece, the wash tub 14 has spaced top and bottom walls 16 and 18, spaced sidewalls 20, a front wall 21, and a rear wall 22. In this configuration, the walls 16, 18, 20, 21, and 22 collectively define the treating chamber 24 for washing utensils. The front wall 21 may be a moveable element or door of the dishwasher 10, which may be moveably mounted to the cabinet 12 to provide selective access to the wash tub 14 for loading and unloading utensils or other washable items.

Utensil holders in the form of upper and lower utensil racks 26, 28 are located within the treating chamber 24 and receive utensils for washing. The upper and lower racks 26, 28 may be mounted for slidable movement in and out of the treating chamber 24 for ease of loading and unloading. As used in this description, the term "utensil(s)" is intended to be generic to any item, single or plural, that may be treated in the dishwasher 10, including, without limitation; dishes, plates, pots, bowls, pans, glassware, and silverware. While the present invention is described in terms of a conventional dishwashing unit as illustrated in FIG. 1, it could also be implemented in other types of dishwashing units such as in-sink dishwashers or drawer dishwashers including drawer dishwashers having multiple compartments.

Figure 2:
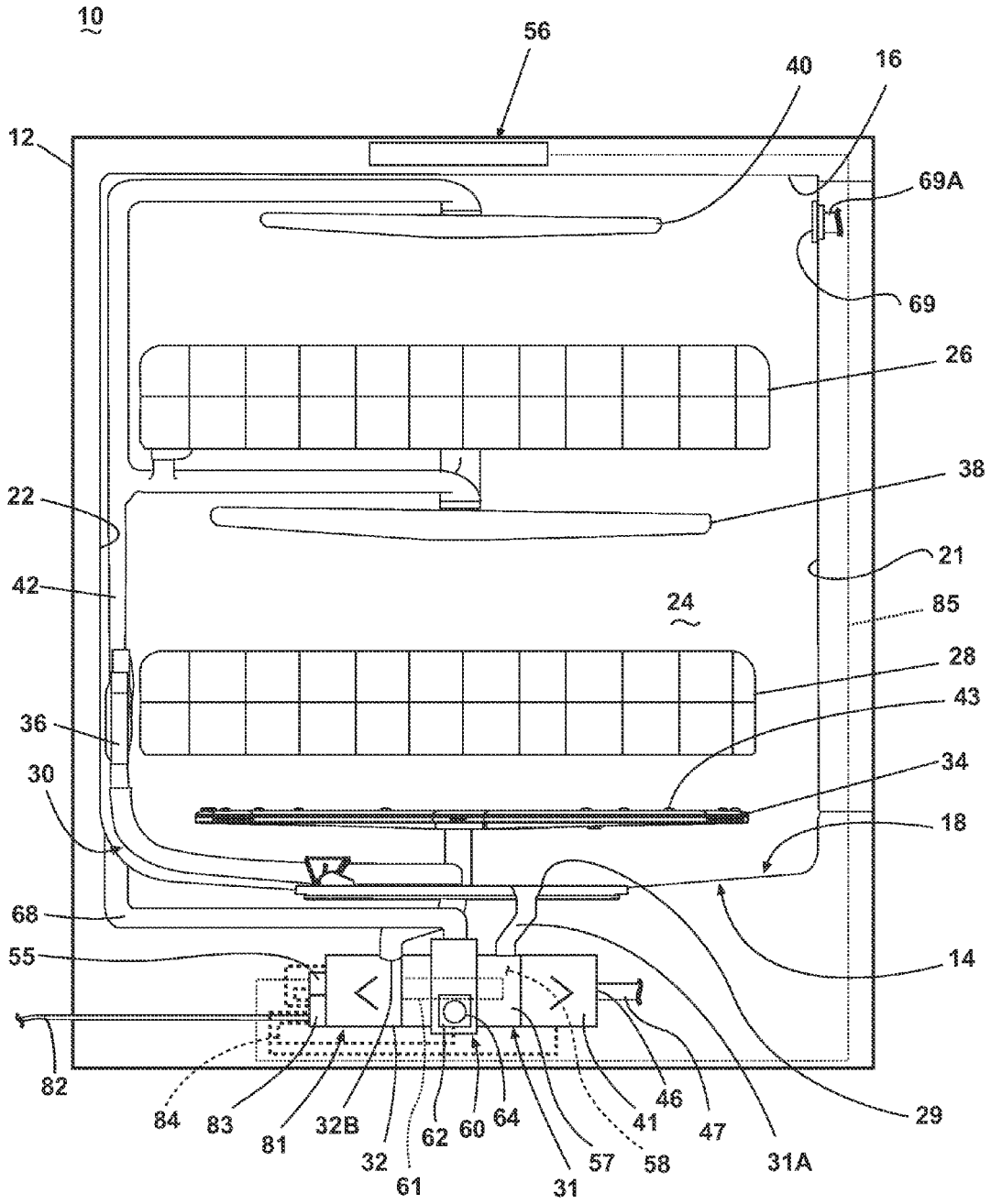
FIG. 2 is a partial schematic cross-sectional view of the dishwasher shown in FIG. 1 and illustrating a recirculation system and air supply system.

Referring to FIG. 2, the major systems of the dishwasher 10 and their interrelationship may be seen. A recirculation system 30 is provided for spraying liquid within the treating chamber 24 to treat any utensils located therein. An air supply system 60 is provided for supplying air to the treating chamber 24 for aiding in the drying of the utensils. The recirculation system further comprises a wash unit 31 that is operably coupled to the recirculation system 30 and the air supply system 60, such that it provides pumping for the recirculation system 30, and heating for both the recirculation system 30 and the air supply system 60, along with a draining function.

The recirculation system 30 comprises one or more sprayers for spraying liquid within the treating chamber 24. As illustrated, there are four sprayers: a first lower spray assembly 34, a second lower spray assembly 36, a mid-level spray assembly 38, and an upper spray assembly 40, which are supplied liquid from a supply tube 42. One or more valves may be provided with the supply tube 42 to control the flow of liquid to the various sprayers. In this way, liquid may be selectively supplied to a subset of all of the sprayers and/or simultaneously to all of the sprayers.

The first lower spray assembly 34 is positioned above the bottom wall 18 and beneath the lower utensil rack 28. The first lower spray assembly 34 is an arm configured to rotate in the wash tub 14 and spray a flow of liquid from a plurality of spray nozzles or outlets 43, in a primarily upward direction, over a portion of the interior of the wash tub 14. A first wash zone may be defined by the spray field emitted by the first lower spray assembly 34 into the treating chamber 24. The spray from the first lower spray assembly 34 is sprayed into the wash tub 14 in typically upward fashion to wash utensils located in the lower utensil rack 28. None of the outlets 43 spray directly onto a liquid outlet 29 in the bottom wall 18 as the lower spray assembly 34 rotates.

The second lower spray assembly 36 is illustrated as being located adjacent the lower rack 28 toward the rear of the treating chamber 24. The second lower spray assembly 36 is illustrated as including a horizontally oriented distribution header or spray manifold 44 having a plurality of nozzles 50, each with a plurality of apertures 52. The spray manifold 44 may not be limited to this position; rather, the spray manifold 44 could be located in virtually any part of the treating chamber 24. Alternatively, the manifold 44 could be positioned underneath the lower rack 28, adjacent or beneath the first lower spray assembly 34. Such a spray manifold is set forth in detail in U.S. Pat. No. 7,594,513, issued Sep. 29, 2009, and titled "Multiple Wash Zone Dishwasher," which is incorporated herein by reference in its entirety.

The second lower spray assembly 36 may be configured to spray a flow of treating liquid from the apertures 52, in a generally lateral direction, over a portion of the interior of the treating chamber 24. The spray from the apertures 52 may be typically directed to treat utensils located in the lower rack 28. A second wash zone may be defined by the spray field emitted by the second lower spray assembly 36 into the treating chamber 24. When both the first lower spray assembly 34 and the second lower spray assembly 36 emit spray fields the first and second zones may intersect.

The mid-level spray arm assembly 38 is positioned between the upper utensil rack 26 and the lower utensil rack 28 Like the first lower spray assembly 34, the mid-level spray assembly 38 may also be configured to rotate in the dishwasher 10 and spray a flow of liquid from at least one outlet 43, in a generally upward direction, over a portion of the interior of the wash tub 14. In this case, the spray from the mid-level spray arm assembly 38 is directed to utensils in the upper utensil rack 26 to define a third spray zone. In contrast, the upper spray arm assembly 40 is positioned above the upper utensil rack 26 and generally directs a spray of liquid in a generally downward direction to define a fourth spray zone that helps wash utensils on both upper and lower utensil racks 26, 28.

The wash unit 31 comprises a wash or recirculation pump 32 and a drain pump 41, which are fluidly coupled to a housing 57 defining a sump 58, where liquid sprayed into the wash tub 14 will collect due to gravity. As illustrated, the housing 57 is physically separate from the wash tub 14 and provides a mounting structure for the recirculation pump 32 and drain pump 41. An inlet conduit 31A fluidly couples the wash tub 14 to the housing 57 and provides a path for the liquid in the treating chamber 24 to travel to the sump 58. A filter element 61, shown in phantom, has been illustrated in FIG. 2 as being located within the housing 57 between the inlet conduit 31A and the recirculation pump 32. As illustrated, the recirculation pump 32 fluidly couples the sump 58 to the supply tube 42 to effect a supplying of the liquid from the sump 58 to the sprayers. As illustrated, the drain pump 41 fluidly couples to a drain pump outlet 46 to effect a supplying of liquid from the sump to a household drain 47.

The inlet conduit 31A, sump 58, recirculation pump 32, spray assemblies 34-40, and supply tube 42 collectively form a liquid flow path in the recirculation system 30. The recirculation pump 32 is fluidly coupled to the recirculation path such that it draws liquid in through the inlet conduit 31A and sump 58 and delivers it to one or more of the spray assemblies 34-40 through the supply tube 42. One or more valves or diverters (not shown) may also be included in the dishwasher 10 to control the flow of liquid to the spray assemblies 34-40 from the recirculation pump 32. The liquid is sprayed back into the treating chamber 24 through the spray assemblies 34-40 and drains back to the sump 58 where the process may be repeated. Thus, a liquid flow path fluidly couples the treating chamber 24 to the spray assemblies 34-40.

The drain pump 41 may also be fluidly coupled to the housing 57. The drain pump 41 may be adapted to draw liquid from the housing 57 and to pump the liquid through a drain pump outlet 46 to a household drain 47. As illustrated, the dishwasher 10 includes a recirculation pump 32 and a drain pump 41. Alternatively, it is possible for the two pumps to be replaced by a single pump, which may be operated to supply to either the household drain or to the recirculation system.

The air supply system 60 comprises an inlet duct 68 coupled to the wash tub 14, with an inlet 64 located below the bottom wall 18 such that air exterior to the tub 14, i.e., "ambient air", may be provided to the treating chamber 24. A fan or blower 62 is fluidly coupled to the inlet duct 68 through an air supply conduit 66 to draw in the ambient air through the inlet 64 and supply it to the treating chamber 24 through the air supply conduit 66 and air inlet duct 68. An air outlet, such as a vent 69, is provided for exhausting the supplied air from the treating chamber 24. As illustrated, the vent 69 is fluidly coupled to an outlet duct 69A, which vents into the interior of the door 21 and will escape through the various openings in the door 21. However, the outlet duct 69A may extend completely through the door 21. It should be noted that a flap or other means (not shown) may be used to close off the fluid connection between the outlet duct 68 and the wash tub 14 during certain portions of the cycle of operation so that liquid does not enter the outlet duct 68.

The pump assembly 32 of the recirculation system 30, the blower 62 of the air supply system 60, and the drain pump 41, are all high voltage components that are physically arranged as a unit or module. These components may be thought of as forming a high voltage module 81. As used in this description, the term "high voltage" is intended to be generic to any household AC voltage, such as a single-phase supply having a voltage between about 110 and 120 volts, and a three-phase supply having a voltage of between 208 and 240 volts. While the household AC voltage varies from country to country, typically it is greater the 100 volts. High voltage is not intended to include traditional DC voltage with a voltage of 0-24 volts, which is typically used as control signals. As used in this description the term "low voltage" is intended to be generic to a DC voltage typically less than about 24 volts. The voltages and voltage ranges described above are not meant to be limiting and may vary depending upon location.

A high voltage inlet 82 provides power to the high voltage module 81. More specifically, a power block 83 may extend from the high voltage inlet 82 and may have a high voltage wiring harness 84 extending from it to the components of the high voltage module 81. The standard house line voltage may be between about 110 and 120 volts. The power block 83 and high voltage wiring harness 84 are illustrated as being the only high voltage electrical supply in the cabinet 12. Notably, the high voltage wiring harness 84 bypasses the door 21.

A low voltage control panel or user interface 56 may be provided on the cabinet 12 or on the outer panel of the door of the dishwasher 10. In the illustrated dishwasher 10, the user interface is the only low voltage component. A low voltage wiring harness 85 provides electrical power to the user interface. The user interface 56 may be operably coupled to a controller 55 such that the user interface 56 may be used to select a cycle of operation. The user interface 56 may include operational controls such as dials, lights, switches, and displays enabling a user to input commands. The dishwasher 10 may further include other conventional components such as additional valves, a dispensing system for dispensing treating chemistries or rinse aids, spray arms or nozzles, etc.; however, these components are not germane to the present invention and will not be described further herein.

Separation of the high voltage components from the low voltage components provides freedom to locate the high voltage components within the dishwasher 10. As illustrated, the high voltage components are located within the dishwasher 10 such that they are remote from the location where a user interacts with the dishwasher.

Figure 3:
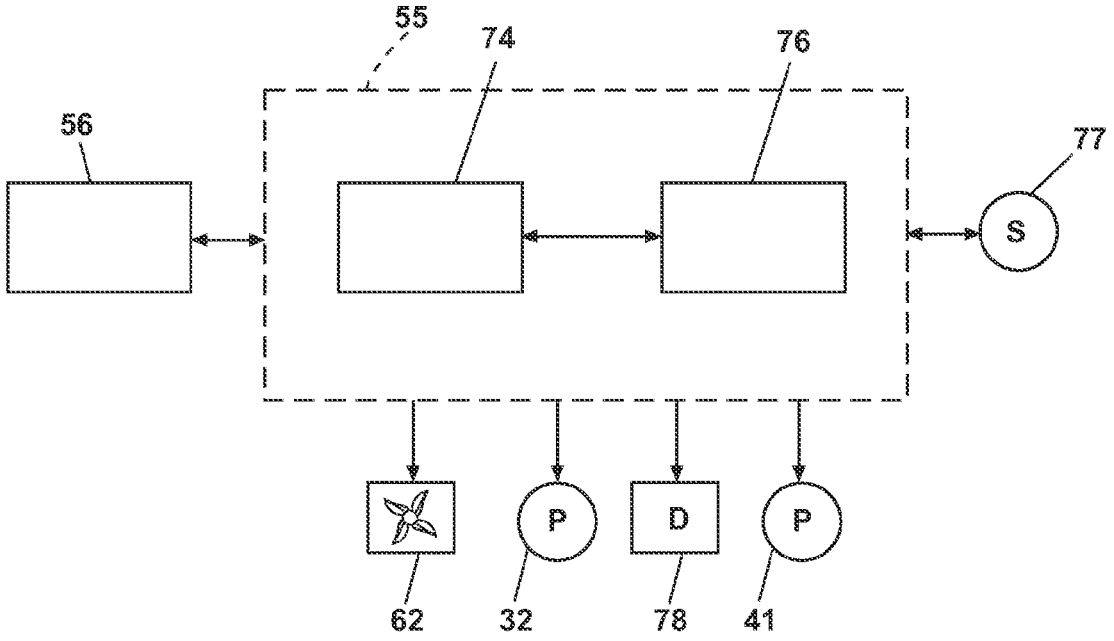
FIG. 3 is a schematic view of a control system of the dishwasher of FIG. 1.

As illustrated in FIG. 3, a controller 55 is provided for controlling the components of the dishwasher according to a cycle of operation. As illustrated, the controller 55 forms part of the high voltage module (FIG. 2) and couples to the user interface via the low voltage wiring harness 85.

The controller 55 may be provided with a memory 74 and a central processing unit (CPU) 76. The memory 74 may be used for storing control software that may be executed by the CPU 76 in completing a cycle of operation using the dishwasher 10 and any additional software. For example, the memory 74 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 55 may be operably coupled with one or more components of the dishwasher 10 for communicating with and controlling the operation of the components to complete a cycle of operation. For example, the controller 55 may be coupled with the recirculation pump 32 for circulation of liquid in the wash tub 14 and the drain pump 41 for drainage of liquid in the wash tub 14. The controller 55 may also be operably coupled with the blower 62 to provide air into the wash tub 14.

Further, the controller 55 may also be coupled with a variety of sensors 77 such that the controller 55 may control the duration of the steps of the cycle of operation based upon information provided by the sensors. Non-limiting examples of sensors 77 that may be communicably coupled with the controller 55 include a temperature sensor, a moisture sensor, a door sensor, a detergent and rinse aid presence/type sensor(s). The controller 55 may also be coupled to a dispenser 78, which may dispense a detergent during the wash step of the cycle of operation or a rinse aid during the rinse step of the cycle of operation.

During operation of the dishwasher 10, the recirculation system 30 may be employed to provide liquid to one or more of the spray assemblies 34-40. Liquid in the wash tub 14 passes into the housing 57 where it may collect in the sump 58. At an appropriate time during the cycle of operation to spray liquid into the treating chamber 24, the controller 55 signals the recirculation pump 32 to supply liquid to one or more of the spray assemblies 34-40. The recirculation pump 32 draws liquid from the sump 58 through the filter element 61 and the recirculation pump 32 where it may then be delivered to one or more of the spray assemblies 34-40 through the supply tube 42 and any associated valving.

Figure 4:
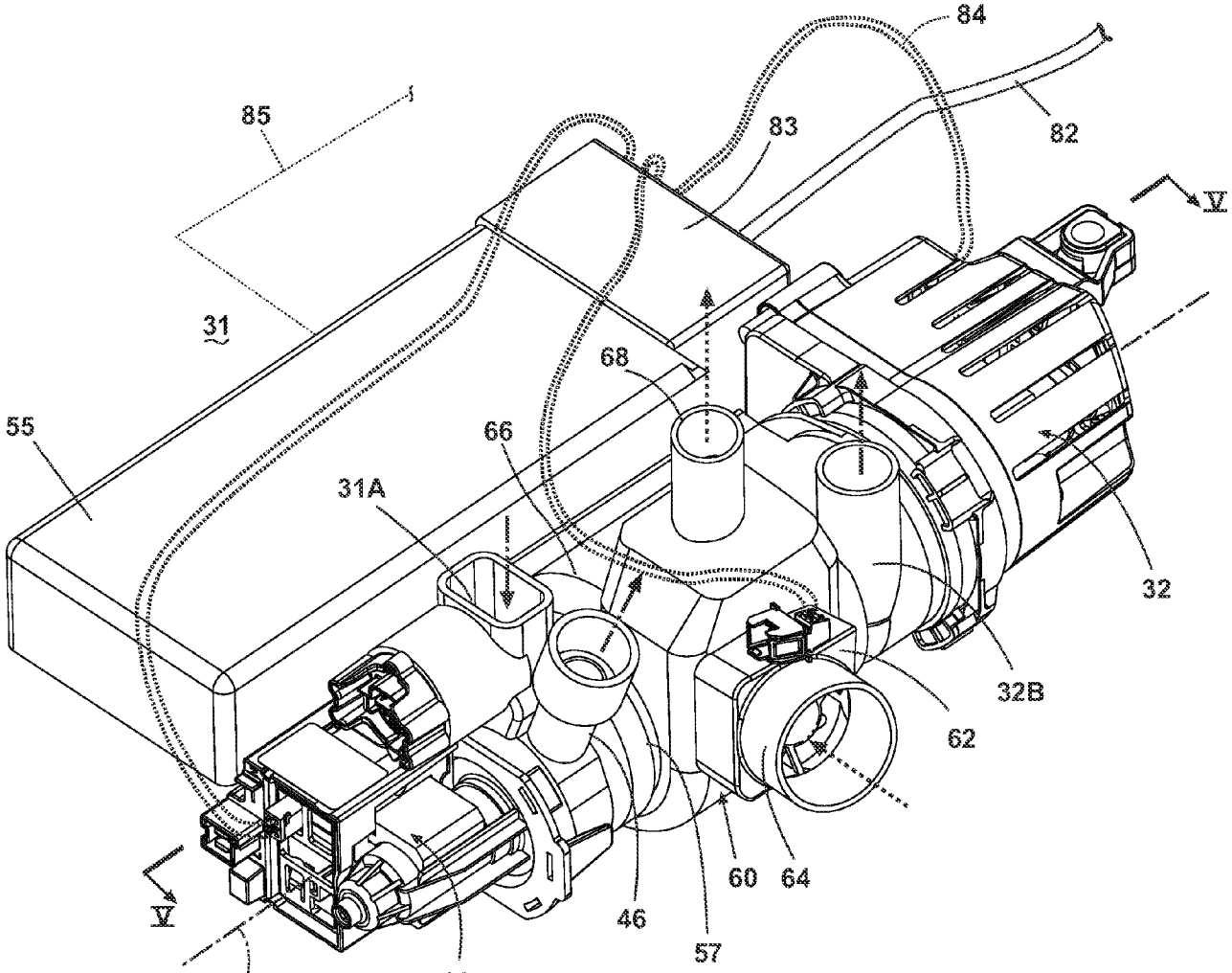
FIG. 4 is a perspective view of one embodiment of the shared wash unit and its couplings to the recirculation system and air supply system illustrated in FIG. 2.

FIG. 4 illustrates a perspective view of one embodiment of the wash unit 31 integrated with the air supply system 60. The wash unit 31 has a drain pump 41 and recirculation pump 32 mounted to the housing 57. The air supply conduit 66 of the air supply system 60 wraps around the housing 57, with the blower 62 located within the air supply conduit 66 just inside the inlet 64. The controller 55 may also be mounted to the wash unit 31.

Figure 5:
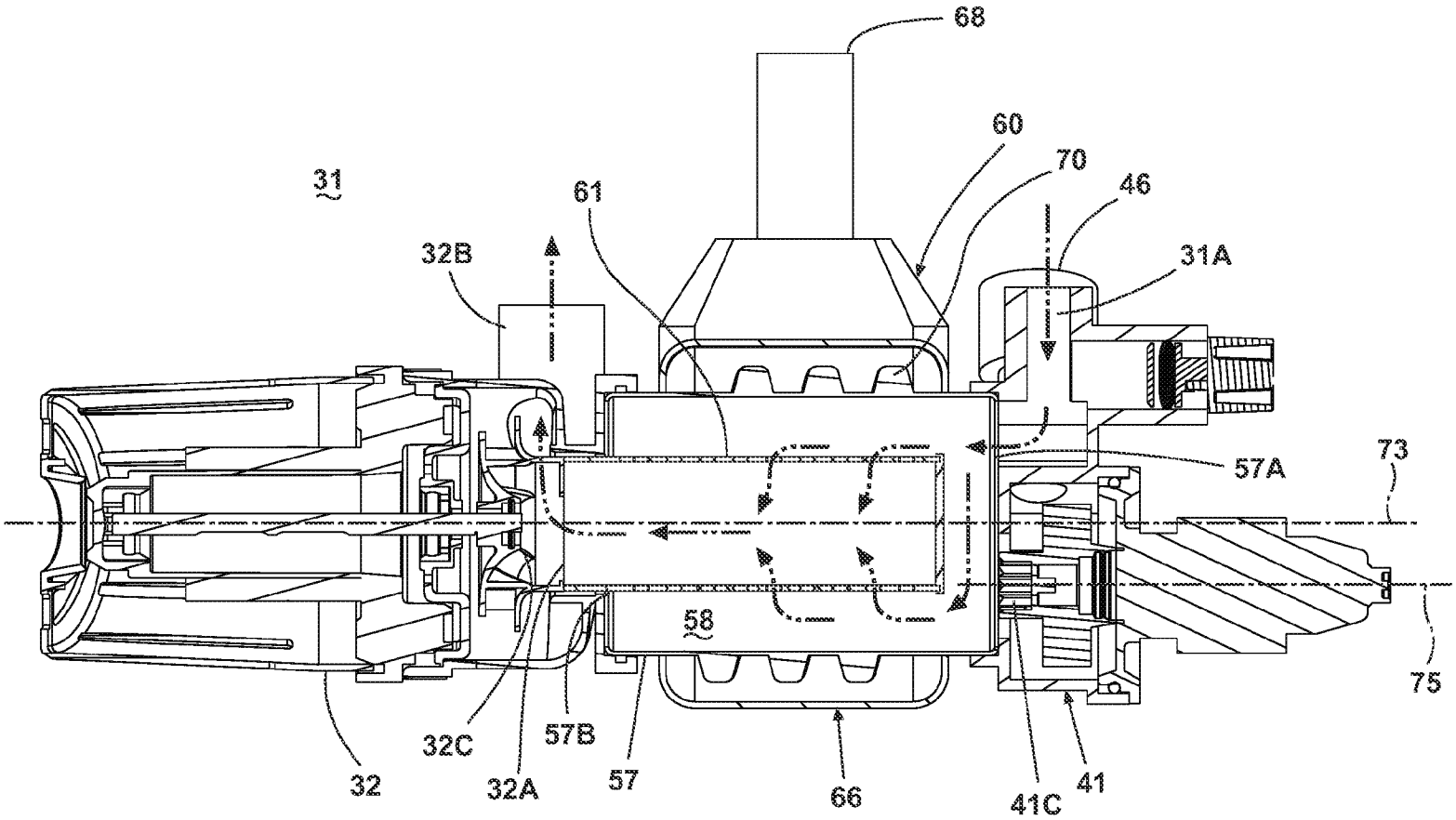
FIG. 5 is a cross-sectional view of the shared wash unit and illustrating a heater that is shared by the recirculation system and air supply system illustrated in FIG. 4.

Referring to FIG. 5, the housing 57 may have a housing inlet 57A, which leads to the sump 58, and a housing outlet 57B. A filter element 61 located in the housing 57 and fluidly disposed between the housing inlet 57A and housing outlet 57B to filter liquid passing through the sump 58. Because the housing 57 is located within the cabinet 12 but physically remote from the wash tub 14, the filter element 61 is not directly exposed to the wash tub 14. In this manner, the housing 57 and filter element 61 may be thought of as defining a filter unit, which is separate and remote from the wash tub 14.

The filter element 61 may be a fine filter, which may be utilized to remove smaller particles from the liquid. The filter element 61 may be a rotating filter and such a rotating filter is set forth in detail in U.S. patent application Ser. No. 12/643,394, filed Dec. 21, 2009, and titled "Rotating Drum Filter for a Dishwashing Machine," which is incorporated herein by reference in its entirety. The rotating filter according to U.S. patent application Ser. No. 12/643,394 may be operably coupled to an impeller 32C of the recirculation pump 32 such that when the impeller 32C rotates the filter element 61 is also rotated.

The recirculation pump 32 may be adapted to draw liquid from the housing outlet 57B in through an inlet 32A and to pump the liquid out through an outlet 32B to the sprayers. The directional arrows in FIG. 5 illustrate the liquid flowing into the housing 57 and the sump 58 where it may then be drawn through the filter element 61 and the recirculation pump 32 when the recirculation pump 32 is operated. In this manner, the filter element 61 fluidly separates the housing 57 from the inlet 32A of the recirculation pump 32. The drain pump 41 may also be fluidly coupled to the housing 57. The drain pump 41 includes an impeller 41C which may draw liquid from the housing 57 and pump it through a drain pump outlet 46 to a household drain 47 (FIG. 2). The filter element 61 is not fluidly disposed between the housing inlet 57A and the drain pump outlet 46 such that unfiltered liquid may be removed from the sump 58.

In FIG. 5, it may also more clearly be seen that a heater 70 may be operably coupled to the controller 55 and may be positioned such that it is mounted to the housing 57 and shared by the recirculation system 30 and the air supply system 60. More specifically, it has been illustrated that the heater 70 is mounted to an exterior of the housing 57 where the air supply conduit 66 wraps around the cylindrical housing 57. In this location, the heater 70 may provide heated air and heated liquid into the wash tub 14 at the same time or may provide heated air and heated liquid into the wash tub 14 separately. Alternatively, it has been contemplated that the heater 70 may be mounted to an interior of the housing 57 or that portions of the heater 70 could be mounted on both the interior and the exterior of the housing 57.

The heater 70 is a variable thermal energy heater, which may be accomplished by altering the duty cycle (ratio of on/off states per unit time) of a fixed wattage heater, a variable wattage heater, or a combination of both. As illustrated, the heater 70 has three rings encircling the housing. The three rings may be an integral unit or independent. As an integral unit, the rings could be part of a heating coil that uses a variable duty cycle to vary the thermal energy output by the heater 70. As independent rings, the desired numbers of rings could be selectively actuated to obtain the desired thermal energy output. For example, if the heater is to run at ⅓ thermal energy output, then only one of the three rings could be continuously actuated. A combination of both approaches could be used such as continuously running a subset of all of the rings, while operating another one or more of the rings according to a duty cycle.

In addition to a coiled heater or multiple ring heater, other heater configurations may be used. For example, it has been contemplated that the heater 70 may be a thin-film heater mounted on the housing 57. The thin film heater may comprise one film or multiple films in much the same manner that the rings may be a coil or individual elements.

It has also been contemplated that the heater 70 may be mounted to the housing 57 and positioned such that it abuts a portion of the air supply conduit 66. In this manner, the air supply conduit 66 need not wrap fully around the housing 57. Instead the air supply conduit 66 may abut or partially envelope the housing 57. In such an instance, the heater 70 may be mounted to the housing 57 where the air supply conduit 66 abuts or partially envelops the housing 57 such that the heater 70 may heat the liquid in the housing 57 and the air in the air supply conduit 66. It should be noted that while the blower 62 has been illustrated as being fluidly coupled with the air supply conduit 66 upstream from the heater 70 such that heated air does not pass through the blower 62, the blower 62 may also be located downstream from the heater 70 such that heated air is passed through the blower 62.

Further, the controller 55 may be coupled with a heater 70 such that it may be used to heat the liquid or heat the air depending on the step being performed in the cycle of operation. If the heater 70 is capable of supplying different wattages, then the controller 55 may also control that aspect of the heater 70.

The impeller 32C of the recirculation pump has a first rotational axis 73 while the impeller 41C of the drain pump 41 has a second rotational axis 75. It has been contemplated that to keep the wash unit 31 low profile, the first and second rotational axes 73, 75 may be parallel, which they are in FIG. 5. Further, in an effort to keep the wash unit 31 low profile, the filter element 61 may also have a third rotational axis, which may be parallel to at least one of the first and second rotational axes 73, 75. As illustrated, the third rotational axis is collinear with the first rotational axis 73, and as such has not been separately labeled, and is thus also parallel to the second rotational axis 75. It has been contemplated that the first, second, and third axes of rotation 73, 75, may all be parallel to each other or may all be collinear.

Further, the housing 57 may also have a longitudinal axis. As illustrated, the longitudinal axis of the housing 57 is also collinear with the first rotational axis 73, and as such has not been separately labeled. It may be understood that the recirculation pump 32, drain pump 41, and housing 57 are arranged such that the first and second axes of rotation 73, 75 are generally parallel with the longitudinal axis to form an overall elongated configuration of the wash unit 31. Further, it should be noted that a longitudinal axis for the remote wash unit 31 may also be considered to be the same as the first axis of rotation. Although not illustrated as such, it has been contemplated that the longitudinal axis of the housing 57 may be collinear with the first, second, and third axes of rotation to define a longitudinal axis for the remote wash unit 31. Further, although the wash unit 31 has been located centrally below the bottom wall 18 it has been contemplated that the wash unit 30 may be located in a lower-rear portion of the interior of the cabinet 12 such that the longitudinal axis of the wash unit 31 is generally parallel to the rear wall of the cabinet 12.

Figure 6:
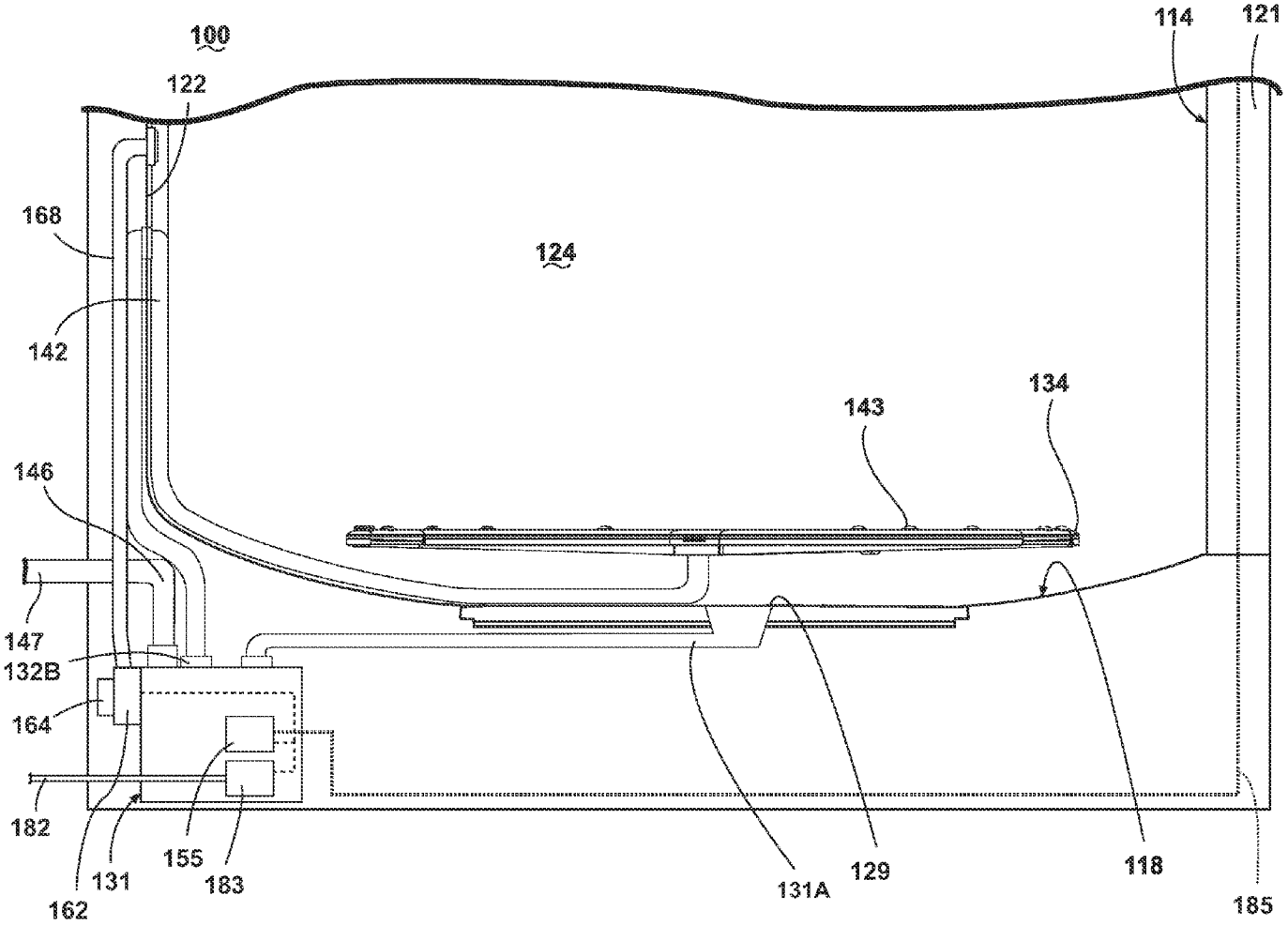
FIG. 6 is a cross-sectional view of a portion of a dishwasher in accordance with a second embodiment of the invention.

FIG. 6 illustrates a dishwasher 100 according to a second embodiment of the invention. The second embodiment 100 is similar to the first embodiment 10. Therefore, like parts will be identified with like numerals increased by 100, with it being understood that the description of the like parts of the first embodiment applies to the second embodiment, unless otherwise noted. FIG. 6 is identical to the embodiment shown in FIG. 2 except that the wash unit 131, sump 158, and air supply system 160 are located in a lower-rear portion of the interior of the cabinet 12 such that the longitudinal axis of the wash unit 131 is generally parallel to a rear wall of the cabinet 12. In all other ways the embodiment of FIG. 6 is structured and operates in the same manner as the first embodiment illustrated in FIG. 2.

Figure 7:
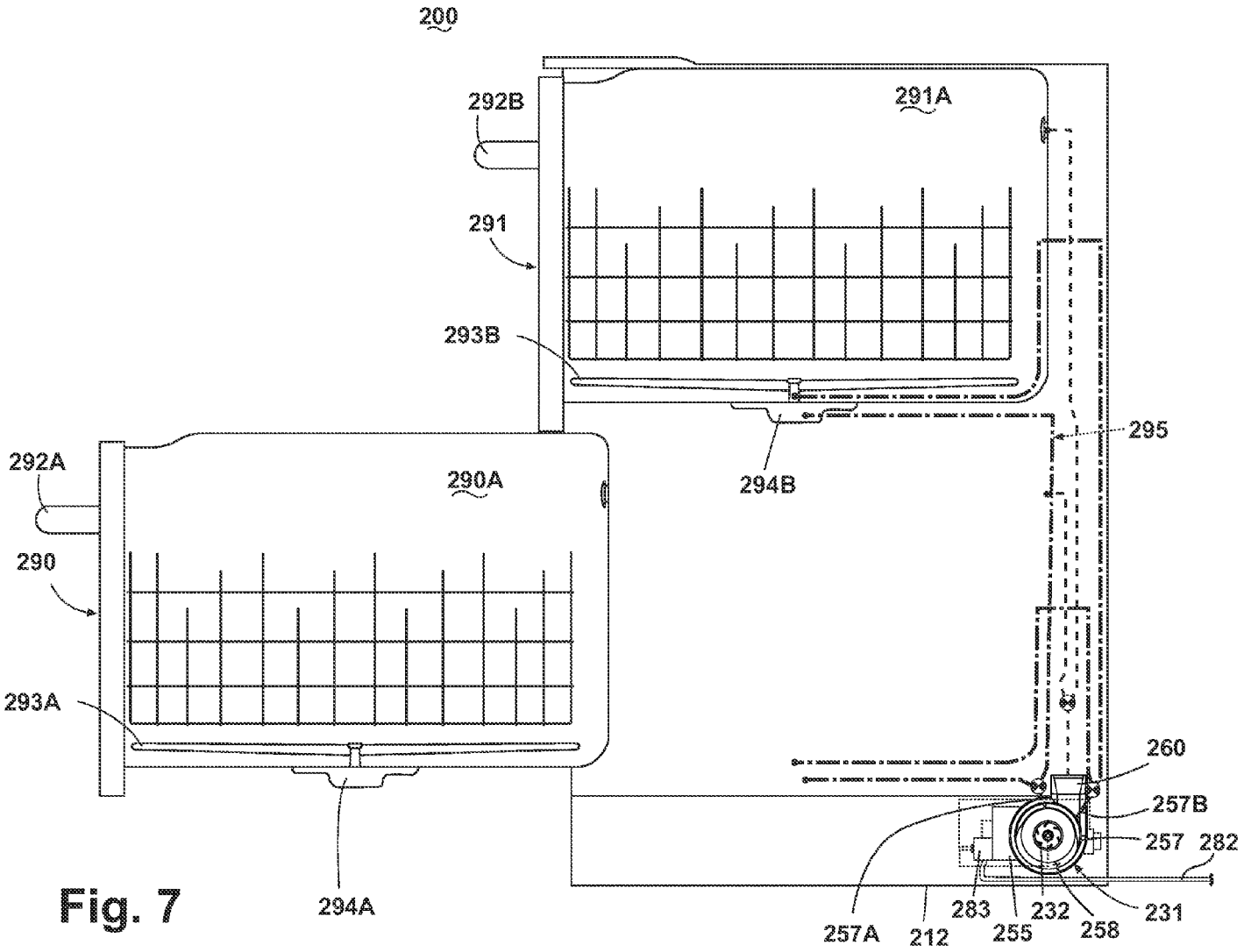
FIG. 7 is a cross-sectional view of a dishwasher in accordance with a third embodiment of the invention.

FIG. 7 illustrates a third embodiment wherein a wash unit 231 is illustrated as being located in a multi-compartment dishwasher 200 having a lower compartment 290 and an upper compartment 291. In this embodiment, the compartments 290, 291 each partially define a treating chamber 290A, 291A. The lower and upper compartments 290, 291 are moveable elements and take the form of slide-out drawer units of similar size, each having a handle 292A, 292B, respectively, for facilitating movement of the drawer units between an open and closed position. The compartments are slidably mounted to the chassis 212 through a pair of extendible support guides (not shown). The upper compartment 291 is illustrated in the closed position and the lower compartment 290 is illustrated in the open position. In this manner, the lower and upper compartments 290, 291 may carry the treating chamber 290A, 291A between the open and closed positions. Notably, the remote wash unit 231 is not carried by either drawer and is illustrated as being positioned in the lower-rear portion of the chassis 212. Further, the high voltage wiring harness 283 is illustrated as being the only high voltage electrical supply in the cabinet 212 and it bypasses both drawers.

It should be noted that each of the compartments 290, 291 have separate liquid inlets 293A and 293B and separate liquid outlets 294A and 294B and that these liquid inlets 293A, 293B and outlets 294A, 294B are fluidly coupled to the wash unit 231 through a fluid distribution system 295 of various conduits and valves. The wash unit 231 includes a housing 257 defining a sump 258 that is physically separate from both of the compartments 290, 291. The sump 258 may receive liquid sprayed into the treating chamber 290A, 291A. The housing 259 has an inlet 259A fluidly connected to the liquid outlets 294A, 294B when the compartments 290, 291 are in the closed position and an outlet 257B fluidly coupled to the rotating spray arms or liquid inlets 293A, 293B when the compartments 290, 291 are in the closed position to define a recirculation path for the sprayed liquid. The wash unit 231 may include a recirculation pump 232, housing 257, drain pump (not shown), and controller 255 as well as an air supply system 260 and filter unit (not shown).

The embodiments of the invention described above allow for a simple construction, which requires fewer parts to manufacture the dishwasher. Further, the embodiments of the invention described above remove the heater from the tub. This results in a heater which is not exposed to the user and prevents plastic items on the bottom rack from being melted.

The embodiments of the invention described above also allow for a compact assembly of the recirculation system and air supply system. One benefit that may be realized from the compact assembly is that a larger wash tub may be put in the housing. A larger wash tub may result in a larger capacity for utensils, which allows for more utensils to be washed at one time. This results in a saving of both time and energy as the dishwasher needs to be run fewer times to wash the same amount of utensils.

A benefit, which may be recognized from the modularity of the assembly, is that it only requires one high voltage wiring harness. Further, the modularity of the assembly allows it to be more efficiently shielded. As the unitary module is the only assembly or component to which high voltage wiring is supplied, less wiring is required and high voltage lines may be kept out of the moveable elements of the dishwasher. Because the high voltage wiring harness bypasses the moveable element in the dishwasher, the high voltage wiring harness does not fatigue due to movement of the door or drawer. Further, as the controller is a part of the unitary module this also allows for less wiring from the controller to each of the components.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configurations shown in FIGS. 1-7, such as by inclusion of other conduits, utensil racks, valves, spray assemblies, seals, and the like, to control the flow of liquid and the supply of air.

What is claimed is:

1. A dishwasher comprising:

a cabinet defining an interior;

a tub located within the cabinet and at least partially defining a treating chamber having a liquid outlet;

a sprayer located in the treating chamber and spraying liquid into the treating chamber; and a remote sump and filter unit located exteriorly of the tub and comprising:

an enclosed housing defining a sump having a housing inlet fluidly coupled to the liquid outlet of the tub via a first conduit and a housing outlet fluidly coupled to the sprayer to define a liquid recirculation path from the sump to the sprayer;

a filter located within the enclosed housing and fluidly separating the housing inlet from the housing outlet to filter liquid recirculated through the sump; and a wash pump mounted to the enclosed housing and fluidly coupled to the sump to pump the liquid from the sump to the sprayer; and wherein the remote sump and filter unit is physically remote from the tub and fluidly coupled thereto via the first conduit.

2. The dishwasher of claim 1, further comprising a drain pump mounted to the enclosed housing and having an inlet fluidly coupled to the sump and an outlet configured to fluidly couple to a household drain.

3. The dishwasher of claim 2 wherein the enclosed housing further comprises opposing ends and the wash pump is mounted to one of the opposing ends and the drain pump is mounted to the other of the opposing ends.

4. The dishwasher of claim 2 wherein the wash pump has an impeller rotatable about a first axis of rotation, the drain pump has an impeller rotatable about a second axis of rotation, and the enclosed housing has a longitudinal axis, and the wash pump, drain pump, and enclosed housing are arranged such that the first and second axes of rotation are generally parallel with the longitudinal axis to form an overall elongated configuration.

5. The dishwasher of claim 4 wherein the filter is a rotating filter having a third rotational axis, which is parallel to the first and second axes of rotation and the longitudinal axis.

6. The dishwasher of claim 5 wherein the first, second, and third axes of rotation are collinear.

7. The dishwasher of claim 6 wherein the longitudinal axis is collinear with the first, second, and third axes of rotation to define a longitudinal axis for the remote sump and filter unit.

8. The dishwasher of claim 4 wherein the remote sump and filter unit is located in a lower-rear portion of the interior such that the longitudinal axis of the remote sump and filter unit is generally parallel to a rear wall of the cabinet.

9. The dishwasher of claim 1 wherein the cabinet further comprises a moveable element for providing access to the tub.

10. The dishwasher of claim 9 wherein the moveable element is one of a door and a drawer.

11. The dishwasher of claim 10 wherein the drawer defines the tub and the remote sump and filter unit are not carried by the drawer.

12. A dishwasher comprising:

a cabinet;

a tub located within the cabinet and at least partially defining a treating chamber with a bottom wall having a liquid outlet;

a sprayer located in the treating chamber above the bottom wall and having a plurality of spray nozzles through which a liquid is sprayed into the tub;

an enclosed housing physically separate from the tub and defining a sump to receive liquid sprayed into the tub, the enclosed housing having a housing inlet fluidly connected to the liquid outlet of the tub via a first conduit and a housing outlet fluidly coupled to the sprayer to define a recirculation path for the sprayed liquid;

a filter located within the enclosed housing and fluidly separating the housing outlet from the housing inlet to filter liquid passing through the sump; and a wash pump fluidly coupled to the recirculation path to pump the liquid from the sump to the sprayer; and wherein the sump is located within the cabinet and remote from the tub such that the filter is not directly exposed to the tub.

13. The dishwasher of claim 12 wherein the pump has an inlet fluidly coupled to the housing outlet and an outlet fluidly coupled to the sprayer.

14. The dishwasher of claim 13 wherein the wash pump is mounted to the enclosed housing.

15. The dishwasher of claim 14, further comprising a drain pump fluidly coupled to the sump and mounted to the enclosed housing.

16. The dishwasher of claim 15 wherein the enclosed housing comprises opposing ends and the wash pump is mounted to one of the opposing ends and the drain pump is mounted to the other of the opposing ends.

17. The dishwasher of claim 15 wherein the wash pump comprises an impeller having a first rotational axis, the drain pump comprises an impeller having a second rotational axis, and the first and second rotational axes are parallel.

18. The dishwasher of claim 17 wherein the filter is a rotating filter having a third rotational axis, which is parallel to the at least one of the first and second rotational axes.

19. The dishwasher of claim 18 wherein the first, second, and third rotational axes are parallel.

20. The dishwasher of claim 19 wherein the first, second, and third rotational axes are collinear.

21. The dishwasher of claim 12 wherein the cabinet further comprises a door moveably mounted to the cabinet to provide selective access to the tub.

22. The dishwasher of claim 12 wherein the cabinet further comprises a drawer and the drawer defines the tub.

23. A dishwasher comprising:

a cabinet defining an interior;

a tub located within the cabinet and at least partially defining a treating chamber having a liquid outlet;

a sprayer located in the treating chamber and spraying liquid into the treating chamber; and a pump unit located physically remote from the tub and comprising:

an enclosed housing defining a sump having a housing inlet fluidly coupled to the liquid outlet of the tub via a first conduit;

a wash pump mounted to the enclosed housing and having an inlet fluidly coupled to the sump and an outlet fluidly coupled to the sprayer to recirculate liquid from the sump back to the sprayer; and a drain pump having an inlet fluidly coupled to the sump and an outlet configured to fluidly couple to a household drain; and a filter located in the enclosed housing and fluidly separating the housing inlet from the inlet of the wash pump to filter liquid being recirculated from the SUMP to the sprayer;

wherein the wash pump has an impeller rotatable about a first axis of rotation, the drain pump has an impeller rotatable about a second axis of rotation, and the enclosed housing has a longitudinal axis, and the wash pump, drain pump, and enclosed housing are arranged such that the first and second axes of rotation are generally parallel with the longitudinal axis to form an overall elongated configuration.

24. The dishwasher of claim 23 wherein the drain pump is mounted to the enclosed housing.

25. The dishwasher of claim 24 wherein the enclosed housing further comprises opposing ends and the wash pump is mounted to one of the opposing ends and the drain pump is mounted to the other of the opposing ends.

26. The dishwasher of claim 25 wherein the first and second axes are collinear with the longitudinal axis to define a longitudinal axis for the pump unit.

27. The dishwasher of claim 26 wherein the pump unit is located in a lower-rear portion of the interior such that the longitudinal axis of the pump unit is generally parallel to a rear wall of the cabinet.

28. The dishwasher of claim 27 wherein the cabinet further comprises a moveable element for providing access to the tub.

29. The dishwasher of claim 28 wherein the moveable element is one of a door and a drawer.

30. The dishwasher of claim 29 wherein the drawer defines the tub and the pump unit is not carried by the drawer.

31. The dishwasher of claim 23, wherein the filter is rotating filter having a third rotational axis, which is parallel to the first and second axes of rotation and the longitudinal axis.

32. The dishwasher of claim 31 wherein the first, second, and third axes of rotation are collinear.

33. The dishwasher of claim 32 wherein the longitudinal axis is collinear with the first, second, and third axes of rotation to define a longitudinal axis for the pump unit.

* * * * *